United States Patent [19]

Hanson et al.

[11] Patent Number: 4,638,603

[45] Date of Patent: Jan. 27, 1987

[54] DEVICE FOR SHARPENING SINGLE-FLUTE COUNTERSINKS

[76] Inventors: Harvey E. Hanson, 8770 Van Nuys Blvd., #6, Panorama City, Calif. 91402; John A. Amaniera, 13939 Wallabi Ave., Slymar, Calif. 91342

[21] Appl. No.: 823,803

[22] Filed: Jan. 29, 1986

[51] Int. Cl.[4] ..... B24B 3/24

[52] U.S. Cl. ..... 51/219 R; 51/225; 51/232; 51/123 R

[58] Field of Search ..... 51/219 R, 219 PC, 218 P, 51/225, 123 R, 232, 221 R, 127, 288

[56] References Cited

U.S. PATENT DOCUMENTS

| | | | |
|---|---|---|---|
| 2,411,709 | 11/1946 | Brown | 51/219 R |
| 2,848,847 | 8/1958 | Casselman | 51/219 R X |
| 3,030,744 | 4/1962 | Mueller | 51/225 |
| 3,117,402 | 1/1964 | Wollner | 51/219 R X |
| 3,346,996 | 10/1967 | Gentzel | 51/225 |
| 3,916,570 | 11/1975 | Caley . | |
| 4,164,100 | 8/1979 | Wolff . | |
| 4,276,722 | 7/1981 | Bertini . | |
| 4,483,104 | 11/1984 | Wolliver . | |
| 4,489,523 | 12/1984 | Webster . | |
| 4,566,227 | 1/1986 | Wolff | 51/221 R X |

*Primary Examiner*—Frederick R. Schmidt
*Assistant Examiner*—Debra S. Meislin
*Attorney, Agent, or Firm*—Milton Gerstein

[57] ABSTRACT

A device for sharpening a single flute countersink in which a threaded shaft is mounted in an enlarged opening formed at the upper end portion of an upstanding post. One end of the threaded shaft mounts a countersink to-be-sharpened, while the other end has a knurled portion to allow for the manual rotation of the shaft. A collar is provided adjacent to the knurled end of the shaft which collar has a projecting pin that cooperates with a projecting pin from the side of the upstanding post, to thereby limit the arcuate rotation of the shaft and attached countersink to less than 360°, in accordance with the arcuate extent of the cutting surface of the single flute countersink. Upon sharpening of the countersink, it is simultaneously rotated and translated in one direction, in accordance with the geometry of a single flute countersink. The enlarged opening is formed at the upper end portion of the upstanding post by a bifurcated extension, such that the inner surface constituting the enlarged opening may be tightly gripped against the threads of the threaded shaft. The lower end of the upstanding post is provided with a supporting surface having a pair of differently-sized canted side edge surfaces so as to position a countersink at a grinding wheel at a desired angular orientation demanded by the angle of the cutting surface of the single flute countersink.

3 Claims, 8 Drawing Figures

FIG. 5
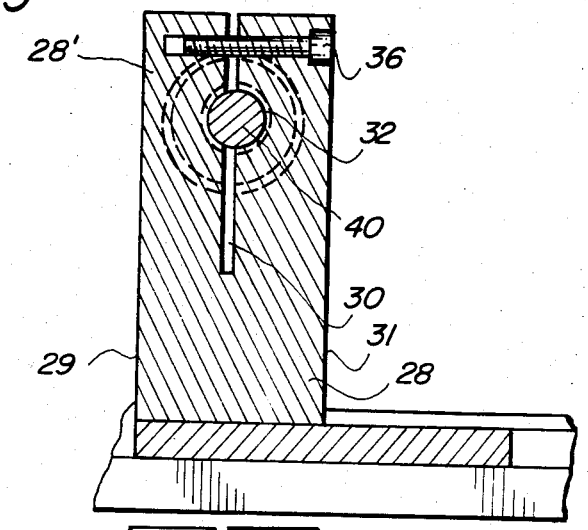
FIG. 7
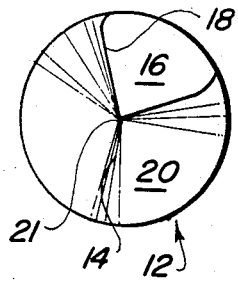
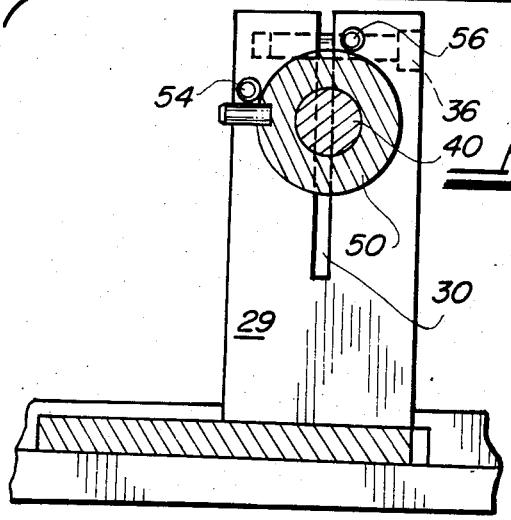
FIG. 6
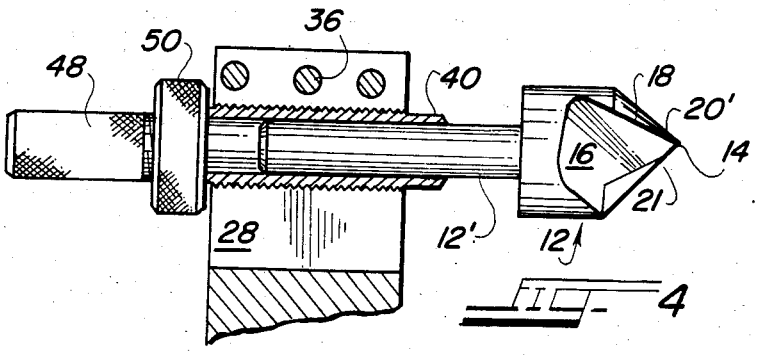
FIG. 4

DEVICE FOR SHARPENING SINGLE-FLUTE COUNTERSINKS

BACKGROUND OF THE INVENTION

The present invention is directed to a device for use with a conventional grinding machine for sharpening single-flute countersinks, which countersinks are used to form a countersink in a surface receiving a screw, or the like. Countersinks come in many different numbers of flutes, or cutting edges, with the generally more common one being the single flute countersink, which is used for all types of surfaces. Hithertofore, when such a single-flute countersink has been used alot and has become dulled, there has not been any feasible and economical manner by which such single-flute countersink may be re-sharpened for continued use and prolonged life. Usually, these worn countersinks are simply discarded and replaced by a new one. Conventional grinding machines are not capable of sharpening these single-flute countersinks, as they may sharpen conventional drill bits. There are many drill-bit attachments for surface grinding machines, but these can only be used to sharpen and renew drill bits, not countersinks, and especially not single-flute countersinks.

SUMMARY OF THE INVENTION

It is, therefore, the primary objective of the present invention to provide a device for use with a conventional surface grinding wheel machine that allows the re-sharpening and renewal of a conventional single-flute countersink.

It is another objective of the present invention to provide such a device that will allow for the sharpening of at least two distinct angular types of single-flute countersinks.

It is still another objective of the present invention to provide such a device that is readily adaptable for use with a conventional surface grinding machine's guide rail.

It is yet another objective of the present invention to allow for the unique geometric configuration of the conventional single-flute countersink's surface area and cutting edge such that only the relevant and needed portions thereof contact the surface of the grinding wheel to be sharpened and polished.

It is another objective of the present invention to allow for easy and simple conversion of sharpening one angularly-designed countersink to another angularly-designed countersink, so that both 82° and 90° single-flute countersinks may be sharpened and polished.

It is a further objective of the present invention to allow polishing and cutting of the countersink's surface at only those portions needed, by limiting the rotation of the countersink when in contact with the grinding surface.

Toward these and other ends, the device for use with a surface grinding machine includes a base plate for attaching the device to the magnetic chuck of a conventional surface grinding machine. An upstanding column projects from the upper surface face of the base plate, the upper portion of which is bifurcated and has an elongated through-hole in which is mounted a threaded shaft having a hollow end for telescopingly mounting therein a shaft of a conventional single-flute countersink. Elongated bolts tie fast the bifurcated portion about the threaded shaft so that the surface constituting the through-hole is held in tight contact thereabout.

The threaded shaft may be rotated in the through-hole, the limits of rotations being provided by a collar having a projecting pin member that cooperates with a pair of angularly-spaced pin members intersecting the path of movement of the collar pin member, to thus limit the angular path of movement of the threaded-shaft and mounted countersink to the exact amount necessary for the countersink surface, which in the preferred embodiment is 260°. The base plate preferably is made of a metallic material that be held by the magentic chuck of the surface grinding machine. When sharpening the countersink surface, the surface is held against the grinding wheel surface, and rotated via the threaded shaft, so that the countersink not only rotates but also translates during its contact against the grinding wheel, so that the eccentricity inherent in the single-flute countersink is accomodated.

BRIEF DESCRIPTION OF THE DRAWING

The invention will be more readily understood with reference to the accompanying drawing, wherein

FIG. 4 is a cross-sectional view taken along line 4—4 of FIG. 1;

FIG. 5 is a cross-sectional view taken along line 5—5 of FIG. 1;

FIG. 6 is a cross-sectional view taken along line 6—6 of FIG. 1;

FIG. 7 is an end view of a conventional single-flute countersink that may be sharpened with the device of FIG. 1.

DETAILED DESCRIPTION OF THE INVENTION

Figure 1:
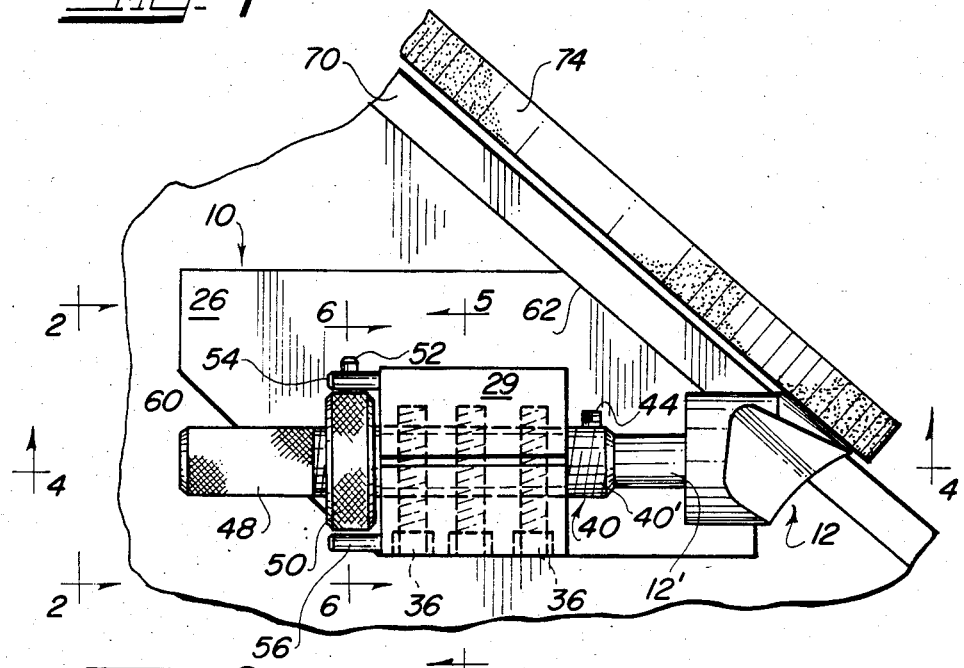
FIG. 1 is a top, plan view of the device for sharpening single-flute countersinks, with the device shown mounted onto a conventional grinding wheel apparatus.

Referring now to the drawings in greater detail, the device of the present invention for sharpening single-flute countersinks used for forming countersinks in surfaces is indicated generally by reference numeral 10. The typical and conventional single-flute countersink is seen best in FIGS. 1, 4 and 7, and can be seen as having a sharpened insertion point 14, and inner cutout portion 16, so as to define a cutting edge 18. The outer surface 20 of the single-flute countersink 12 is not perfectly conical in shape, but is eccentric so that the leading cutting edge surface 20' is exposed so as to define a surface that may cut through a surface to be countersunk. The surface 20 is, therefore, more spiral in nature, in that this eccentricity defines an interconnecting regional surface 21 which would otherwise define a continuation of the perfectly conical shape of the surface directly adjoining the cutting edge 18.

Figure 2:
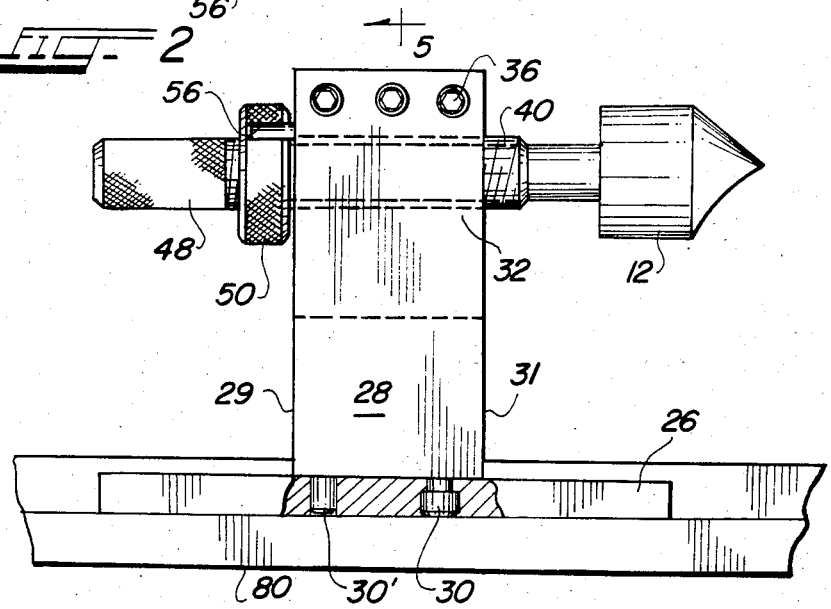
FIG. 2 is a side elevational view of the device for sharpening single-flute countersinks according to FIG. 1.
Figure 3:
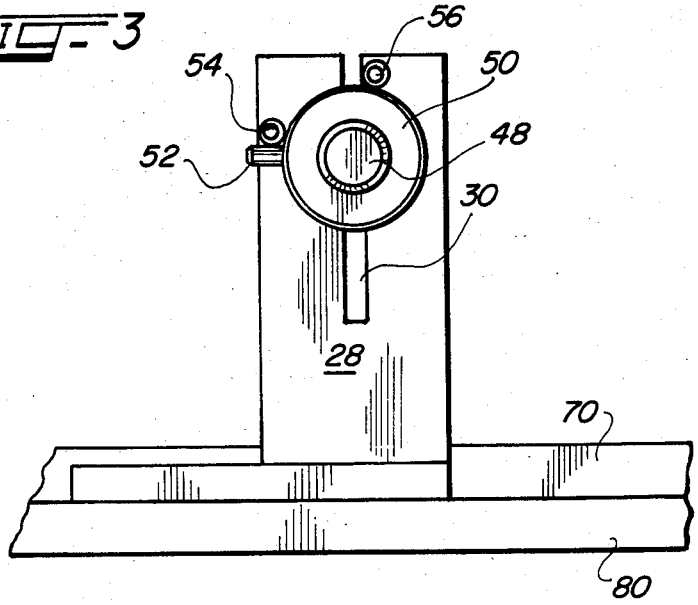
FIG. 3 is an end view of the device for sharpening single-flute countersinks of FIG. 1.

The device 10 for sharpening the conventional single-flute countersink, therefore, incorporates therein the eccentric nature of the cutting surface of the countersink 12. The device 10 includes a mounting base plate 26 which mounts thereto an upstanding, vertical column 28, bolted to the base plate 26 by bolts 30', which are easily removable to allow disassembly of the column 28 from the base plate 26. The upstanding column 28 includes at its upper portion a bifurcated portion indicated by reference numeral 28', and best seen in FIG. 5. This bifurcated portion 28' is formed by an elongated, vertically-downward channel or slot 30 extending all the way to the upper boundary of the column 28, and includes a centrally-located through-hole 32 which passes through the column from one side surface 29 to the other side surface 31 thereof. Three bolts 36 interconnect the upper extremities of the bifurcated region, adjacent the open mouth of the channel, as best seen in FIGS. 5 and 6, so that when a shaft 40 is inserted in the through-hole 32, it may be gripped thereby, to thus form a hole by which the threads of the shaft 40 may gripped to allow the rotation of the shaft therein. The inner surface of the bifurcated portion forming the through-hole 32 is threaded for mating engagement with the threaded outer surface of the shaft 40. Thus, it can be seen that the threaded shaft 40 may be readily accomodated in the bifurcated portion 28' of the upstanding column 28, which threaded shaft has a length substantially longer than the length of the through-hole 32, as can be seen in FIGS. 1 and 2. The shaft 40 is hollow at least along a portion thereof so that the shaft of a conventional single-flute countersink 12 may be inserted therein and held fast by a tightening screw 44, in the conventional manner. Any other fastening means may be used besides the screw 44, such as a conventional collet type mount, or the like.

The portion of which the shaft 40 is made hollow is indicated by reference numeral 40', and projects outwardly beyond the side surface 31 of the upstanding column 28, so that the shaft 12' of the countersink may be telescopingly received therein.

The threaded shaft 40 also includes a knurled end portion 48 oppositely-disposed relative to the hollow portion 40', which knurled end allows for easy rotation of the threaded shaft in the through-hole 32, and the concomitant translational movement of the shaft via the threads thereof. Concentrically-mounted about the threaded shaft 40, directly adjacent the knurled end portion thereof, is a collar 50 which has an inner threaded mounting opening for mounting it about the threaded shaft, for conjoint rotation. Thus, this collar 50 is relatively-movable with the threaded shaft 40. The collar 50 also includes a projecting pin member 52 generally projecting parallel to the vertical, upstanding axis of the column 28. The pin 52 preferably projects beyond the horizontal plane containing therein the upper surface face of the column 28. Two cooperating projecting pin members 54 and 56 are provided on the side surface 29 of the column 28, adjacent the upper portion of the bifurcated region thereof. These pin members 54 and 56 cooperate with the pin members 52 to limit the rotation of the shaft 40 to a desired and specific angular rotation, which in the case of the conventional single-flute countersink is approximately 260°. Though the pin members 54 and 56 are not shown in the same general plane, it is to be understood that any relative mounting of the pins 52,54 and 56 may be provided as long as the rotation allowed thereby is that which is necessary for the conventional countersink being sharpened. Further, instead of two pin members 54 and 56, only one pin member protruding from the side surface 29 need be provided, which one pin member would be of sufficient width as to define the limits of the rotation of the threaded shaft to the necessary arcuate path. The size and shape of just one pin, and its location on the side surface 29, would be obvious to one having ordinary skill in the art, in order to limit the rotation of the threaded shaft 40 to a desired 260° arcuate path.

Figure 8:
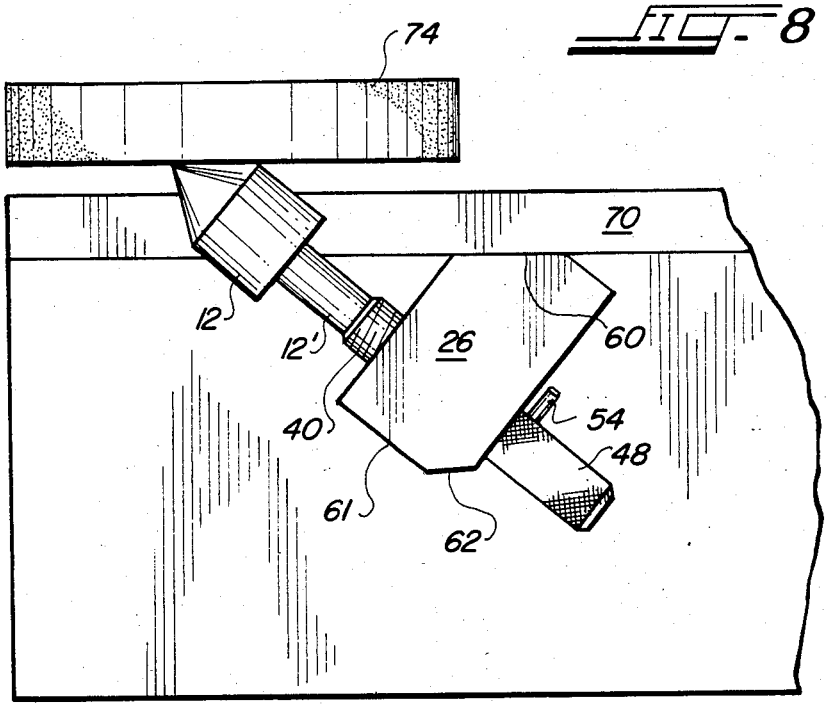
FIG. 8 is a top view similar to FIG. 1 but showing the single-flute countersink being sharpened at a different inclusive angle thereof by using the other canted guiding edge surface of the mounting base plate of the device.

Referring to FIG. 8, it can be seen that the base plate 26 is provided, in the preferred form of the invention, with a pair of oppositely-disposed, canted aligning side surfaces indicated by reference numerals 60 and 62. Canted surface 60 preferably forms an angle of 41° with respect to the straight surface 61, while the canted surface 62 forms a relative angle with respect to the same surface 61 of 45°, so that conventional, single-flute countersinks of 82° and 90° may be sharpened, which countersink angles refer to the angle the outer surface 20 makes at its apex defined by the point 14, to thus define the inclusive angle therebetween.

As shown in FIGS. 1 and 8, these canted aligning surfaces 60 and 62 are used by aligning them against the guide rail 70 of a conventional grinding machine 72, having a conventional surface grinding wheel 74 thereof. Such a machine is may be that made by Enco, model 120-5618 or model 120-5612.

To use one or the other of the canted surfaces 60 and 62 requires only that at assembly of the device of the present invention, that the base plate 26 be oriented as shown in FIG. 1 to use the canted surface 62, or be rotated 180° relative to the upstanding column 28 to use the canted surface 60 in abutting relationship against the guide rail 70. Conversion from one angular mode to another is simply achieved by using bolts 30 which are symmetrically arranged so that upon rotation of the base plate, this symmetrical relationship allows for easy installation in either relative orientation.

When using the device of the present invention, the shaft 12' of the single-flute countersink 12 is inserted into the hollow end of the threaded shaft 40 and held fast therein by set screw 44. The countersink surface 20 is so oriented so that the cutting edge 18 is the portion that will first contact the grinding surface of grinding wheel 74, which also corresponds to the contact of the projecting pin member 52 against the protruding pin member 54, to thus define the starting point of the sharpening process. The pin 52 is initially set up into contact with the pin 54 by adjusting the rotatable collar 50 relative to the threaded shaft 40, the lengths of the pin members 54 and 56 permitting leeway in the initial setting up. After the setting up has been achieved, the threaded shaft may be rotated via knurled end portion 48 in the counter-clockwise direction when viewing FIG. 6 until the pin member 52 abuts against the pin member 56 to define the limit of the angular rotation. During such rotation of the threaded shaft 40, the surface 20 of the single-flute countersink 12 is moved against the grinding surface of the grinding wheel, at the angle established by one of the canted surfaces 60 and 62, the chosen canted surface defining the angle of cut by its contact against the guide rail of the grinding machine. When the threaded shaft 40 is rotated via knurled end portion 48, the countersink will be caused to translate just as the threaded shaft 40 translates by the contact of its exterior threads against the inner surface area of the through-hole formed in the upper bifurcated portion. Thus, as the shaft is rotated through the approximate 260° arcuate path, the countersink is caused to extend slightly during the rotation, to cause the eccentricity of the countersink surface area 20 to be accomodated, as described above. The degree to which the countersink is extended during rotation is controlled by the pitch of the threads of the threaded shaft 40. Thus, during the rotation the entire surface area 20 of the countersink is polished and the cutting edge 18 thereof sharpened. It is to be understood, of course, that the initial setting up of the countersink in the threaded shaft may be altered so that any portion of the surface 20 of the countersink may be associated with the starting point, with an associated relative position of the pin 52 being changed to suit such initialization procedure.

While a specific embodiment of the invention has been shown and described, it is to be understood that numerous changes and modifications thereof may be made without departing from the scope, spirit and intent of the invention as set out in the appended claims, of which form part of the disclosure hereof. For example, instead of using the base plate 26 which is capable of being held fast to the magnetic chuck of the surface grinding machine, indicated by reference numeral 80 in FIG. 2, one may do away with this base plate altogether, and angularly mount the bottom of the upstanding column 28 itself directly to magnetic chuck of the surface grinding machine, such angular alignment being achieved manually by a protractor, or the like, so that the threaded shaft and attached countersink are positioned relative to the surface of the grinding wheel 74 the above-described 41° or 45°. Further, other mounts may be used for threadingly receiving the threaded shaft 40, so as to allow both rotation and translation of the countersink to be sharpened.

What is claimed is:

1. A device for sharpening a single-flute countersink comprising:

a mounting plate;

an upstanding post mounted on said mounting plate and having an enlarged opening formed therethrough at an upper portion thereof;

a threaded countersink mounting means for mounting in said enlarged opening having means at one end thereof for securing thereto a shaft of a single flute countersink;

means operatively associated with said threaded mounting means for limiting the rotation of said threaded mounting means to considerably less than 360 degrees in said enlarged opening;

a grinding machine having a work-table for supporting thereon said upstanding post, a guide rail, and a surface grinding wheel rotatable in a vertical plane, said grinding wheel having a front grinding surface face contained in a vertical plane against which a single-flute countersink is sharpened;

means for orienting said threaded mounting means at a desired angular position relative to said front face of said grinding wheel, said means for orienting comprising a first canted side edge surface of said mounting plate, and a second canted side edge surface of said mounting plate, said first and second side edge surfaces being diametrically opposite each other, so that each of said side edge surfaces may be used to position said mounting plate at a desired angle relative to said front face of said grinding wheel, said first side edge surface having a different angle of cut than said second side edge surface to accomodate two different types of single-flute countersinks, one of said first and second canted side edge surfaces being in abutting contact with said guide rail of said grinding machine;

means for manually rotating said threaded mounting means in said enlarged opening at the other end thereof; said one end of said threaded mounting means lying on the opposite side of said upstanding post as compared with said other end of said threaded mounting means;

said mounting plate and said upstanding post mounting thereon being positioned on said work table in front of said front face of said surface grinding wheel, said threaded countersink mounting means comprising a shaft having a hollow end, said shaft lying entirely in front of said front face and at an angle with respect thereto of one of the angles of one of said first and second canted side edge surfaces such that the longitudinal axis of said shaft intersects said front face at said one angle;

said means limiting the rotation comprising a collar member rotatable with said shaft at the end thereof remote from said hollow end, said collar member comprising a circumferentially projecting pin, said upstanding post having a side surface facing toward said collar and having a pair of angularly spaced-apart projecting stop members projecting away from said grinding wheel for limiting the rotation of said collar and said shaft by the cooperation of said pin member with said pair of stop members, said collar having an inner threaded opening for receiving therethrough said end of said shaft remote from said hollow end, whereby said collar may be adjusted along the length of said shaft.

2. The device according to claim 1, wherein said upstanding post comprises a bifurcated upper portion defining said enlarged opening, a groove extending downwardly and upwardly from said enlarged opening, and means for tightening said bifurcated portion to grip the threads of said shaft to allow for the movement of said shaft therein, said means for tightening comprising bolts in said upper portion passing through said groove extending upwardly from said enlarged opening.

3. The device according to claim 2, wherein said first said edge surface is canted at an angle of 41 degrees, and said second side edge surface is canted at an angle of 45 degrees.

* * * * *